US005085334A

United States Patent [19]

Katano et al.

[11] Patent Number: 5,085,334

[45] Date of Patent: Feb. 4, 1992

[54] FLAT PANEL DISPLAY DEVICE

[75] Inventors: Mitsunori Katano; Fumio Yamazaki; Hiroyuki Yamakita, all of Osaka, Japan

[73] Assignee: Matsushita Electric Industrial Co., Ltd., Osaka, Japan

[21] Appl. No.: 608,488

[22] Filed: Nov. 1, 1990

Related U.S. Application Data

[62] Division of Ser. No. 492,573, Mar. 13, 1990, Pat. No. 5,031,788.

[30] Foreign Application Priority Data

Mar. 13, 1989 [JP] Japan ..... 1-59913
May 8, 1989 [JP] Japan ..... 1-114738
Aug. 31, 1989 [JP] Japan ..... 1-226275

[51] Int. Cl.[5] ..... H01K 1/36

[52] U.S. Cl. ..... 220/2.2; 174/50.62; 313/422

[58] Field of Search ..... 220/2.2, 2.1 R, 2.1 A, 220/2.3 R, 2.3 A; 174/50.61, 50.62, 50.63, 50.64; 313/422, 317

[56] References Cited

U.S. PATENT DOCUMENTS 2,916,644 12/1959 Kautz et al. ..... 220/2.2
3,010,045 11/1961 Plagge et al. ..... 220/2.2
3,845,530 11/1974 Platt .
4,325,489 4/1982 Russel et al. .
4,339,482 7/1982 Glaser et al. .
4,591,757 5/1986 Bakker et al. .
4,595,857 6/1956 Rowe et al. .
4,639,636 1/1987 Bakker et al. .
4,786,840 11/1988 Ragland, Jr. .

FOREIGN PATENT DOCUMENTS 0205166 6/1986 European Pat. Off. .
0228052 12/1986 European Pat. Off. .
57-501554 8/1982 Japan .

*Primary Examiner*—Joseph Man-Fu Moy
*Attorney, Agent, or Firm*—Wenderoth, Lind & Ponack

[57] ABSTRACT

A flat panel display device which comprises a face glass plate, a metal container assembled to the face glass plate through a frit glass for providing an envelope for accommodating electron beam generating means and electron beam control means, the metal container including an outer container made of a thin metal plate and an inner container separately assembled to the inside of the outer container for acting as a pressure resistive container for supporting air pressure. Only the outer container is joined to the face glass plate.

5 Claims, 8 Drawing Sheets

FLAT PANEL DISPLAY DEVICE

This application is a Rule 1.60 divisional application of application Ser. No. 07/492,573, filed March 13, 1990, now U.S. Pat. No. 5,031,780.

BACKGROUND OF THE INVENTION

1. Field of the Invention

The present invention relates to a flat panel display device, and more particularly to an improvement of the joining portion of the envelope thereof.

2. Description of the Prior Art

A vacuum envelope of a conventional flat panel display device is shown in FIG. 1, in which a face glass plate 1 of a flat shape and a metal container of a round dome shape are joined together by joining the flange portion of the metal container 2 to the face glass plate 1 by a frit glass 3.

It is noted that throughout the attached drawings, like parts are designated by like reference numerals.

FIG. 2 shows an improved structure of the conventional vacuum envelope shown in FIG. 1, in which a heat bonding material 4 made of a Pb wire is disposed between the glass plate 1 and the metal container 2 and they are clamped by a channel member 5, in addition, the assembled members are heated at 300° C. and the PB wire mode molten to accomplish a hermetic seal. This technique is described in SID 82 DIGEST, page 208.

In the arrangement shown in FIG. 1, upon increasing the thickness of the metal plate of the metal container 2 in order to enhance the pressure resistance of the metal container 2, there may occur cracking in the glass plate at the joint of the metal container 2 and the glass plate 1 due to increasing rigidness of the metal container 2. On the other hand, the container shown in FIG. 2, which is the improvement of that shown in FIG. 1, must be baked in order to enhance the vacuum of the envelope. The baking is required to be performed at 300° C. to 350° C. However, since the melting point of the Pb wire is 300° C., such baking cannot be done.

Moreover, there is another problem that in the arrangement of clamping the flange portion of the glass plate 1 and the metal container 2 by the channel member 5, a tight seal can not be assured unless a sufficient clamping pressure is applied to the channel member 5.

SUMMARY OF THE INVENTION

An essential object of the present invention is to provide an improved flat panel display device which is capable of eliminating various problems described above, and manufactured simply.

In order to accomplish the above object of the present invention, there is provided a flat panel display device which comprises a face glass plate, a metal container assembled to the face glass plate through a frit glass for providing an envelope for accommodating electron beam generating means and electron beam control means, the metal container including an outer container made of a thin metal plate and an inner container separably assembled to the inside of the outer container for acting as a pressure resistive container for supporting the envelope against air pressure. Only the outer container is joined to the face glass plate.

DETAILED DESCRIPTION OF THE PREFERRED EMBODIMENTS

Figure 1:
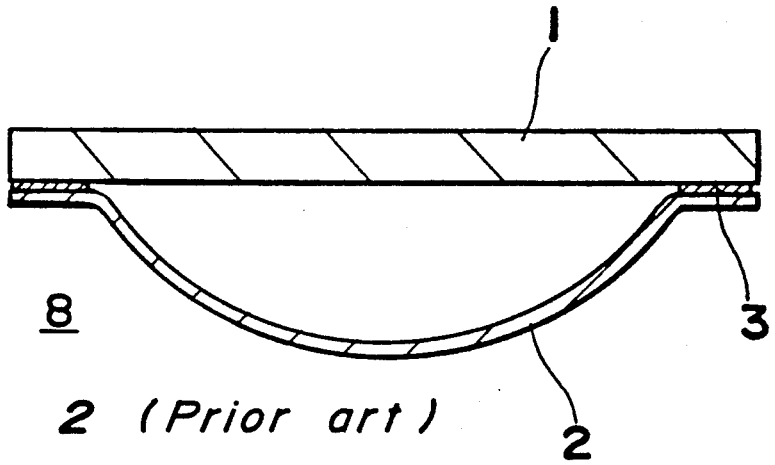
Fig. 1 (Prior art)
FIGS. 1 and 2 are respectively cross sectional views of conventional envelopes of a flat panel display device.
Figure 2:
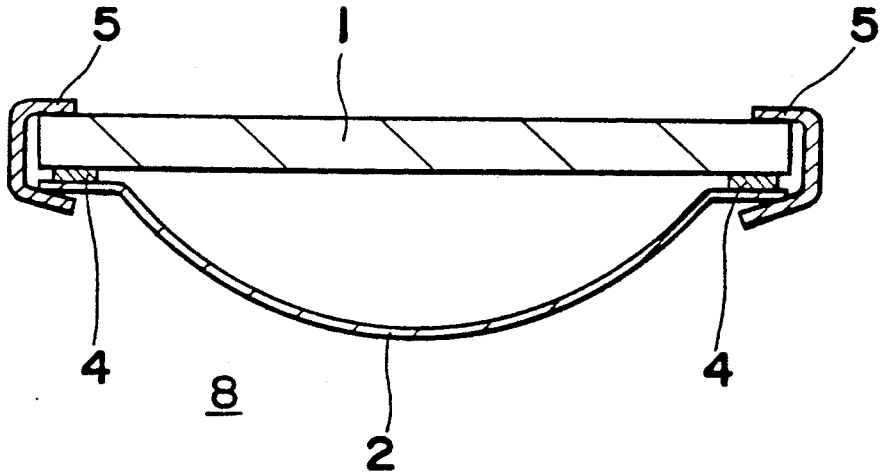
Fig. 2 (Prior art)
Figure 3:
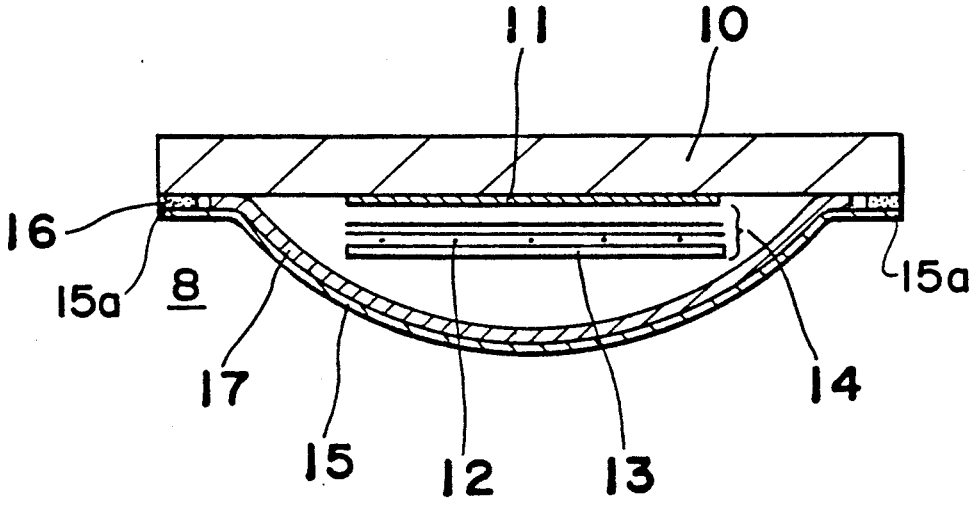
FIG. 3 is a cross sectional view of a first embodiment of an envelope of a flat panel display device according to the present invention.
Figure 4:
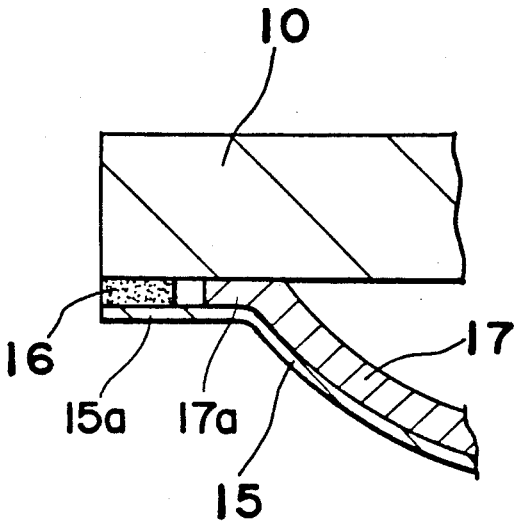
FIG. 4 is a partial cross sectional view of an essential part of the envelope shown in FIG. 3.

Referring to FIG. 3, showing a cross sectional view of a preferred first embodiment of a flat panel display device according to the present invention, there is provided a transparent face glass plate 10 of a flat plate shape, having its inner surface coated with a fluorescent layer 11 for displaying picture by receiving electrons from an electrode in a known manner. The face glass plate 10 is made of soda float glass. Reference numeral 12 denotes a linear cathode, 13 a back face electrode, 14 a control electrode. A plurality of sets of these members 12, 13 and 14 are provided in an envelope 8 in a similar manner to a conventional flat panel display device. 15 denotes an outer container made of a thin metal plate in a form of a generally semi spherical dome shape, having its outer peripheral flange 15*a* affixed to the peripheral edge portion of the face glass plate 10 through a frit glass 16 to seal the envelope 8. The enlarged sealed portion is shown in FIG. 4. 17 denotes a pressure tight container made of a thick metal plate and provided for supporting against air pressure acting on the envelope 8 when the envelope 8 is evacuated to form a vacuum. The outer shape of the pressure tight container 17 is generally the same shape as the outer container 15 so that the inner surface of outer container 15 tightly contacts with the outer surface of the pressure tight container 17. It is noted that the flange portion 17*a* of the pressure tight container 17 is merely clamped between the flange portion 15*a* of the outer container 15 and the glass plate 10. When the interior of the envelope 8 is evacuated, the vacuum is maintained by the joint formed by the frit glass 16 between the outer container 15 and the face glass plate 10. In the embodiment, there is used frit glass having a melting point of 450° C. Accordingly, it is possible to bake the display device sufficiently at 350° C. When the interior of the envelope 8 is evacuated to form vacuum, the outer container 15 is subjected to the air pressure, the outer container is prevented from the breaking since the air pressure is supported by the pressure tight container 17. Since the outer container 15 is made of a thin metal plate, cracking of the glass plate 10 at the joint between the glass plate 10 and the outer container 15 can be prevented even when they are joined. In addition, since the pressure tight container 17 is not bonded to the face glass plate 10, there does not occur a problem of a difference of the expansion coefficient between the glass and the metal. This makes it possible to use material with a large expansion coefficient which is inexpensive, whereby the cost of the display device can be reduced. In order to increase the mechanical strength of the pressure tight container 17, there may be provided one or more ribs on the surface of the pressure tight container which opposes the face glass plate 10.

It is noted that the joining arrangement shown in the drawings is provided in a similar manner all around the periphery of the envelope 8.

Figure 5:
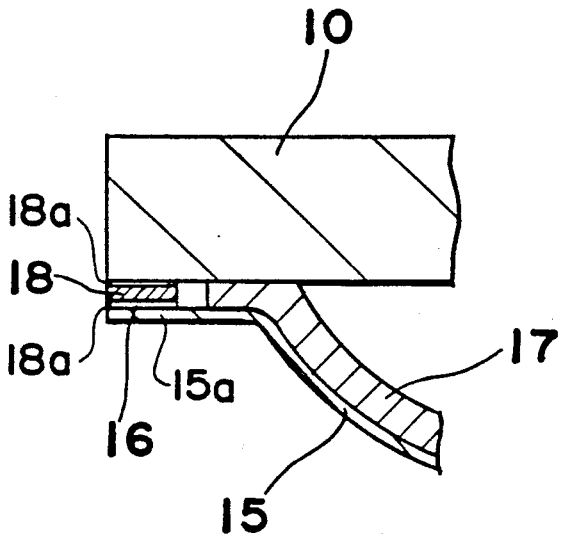
FIG. 5 is a cross sectional view of an essential portion of a second embodiments of the envelope according to the present invention.

FIG. 5 shows a second embodiment of affixing the outer container 15 to the glass plate 10. In this embodiment, a spacer 18 having an expansion coefficient near the expansion coefficient of the face glass plate 10 is disposed between the face glass plate 10 and the flange portion 15*a* of the outer container 15 and the two members 10 and 15 are bonded through bonding materials 18*a* so that the outer peripheral edge portion of the envelope 8 all around is hermetically sealed. In this embodiment, it is possible to increase the expansion coefficient of the material of the outer container 15.

The operation of the display device constructed as above will be explained. By heating the cathode 12, an electron beam is released from the cathode 12. The electron beam can pass the control electrode 14 and impinges the fluorescent layer 11, which emits light.

Figure 6:
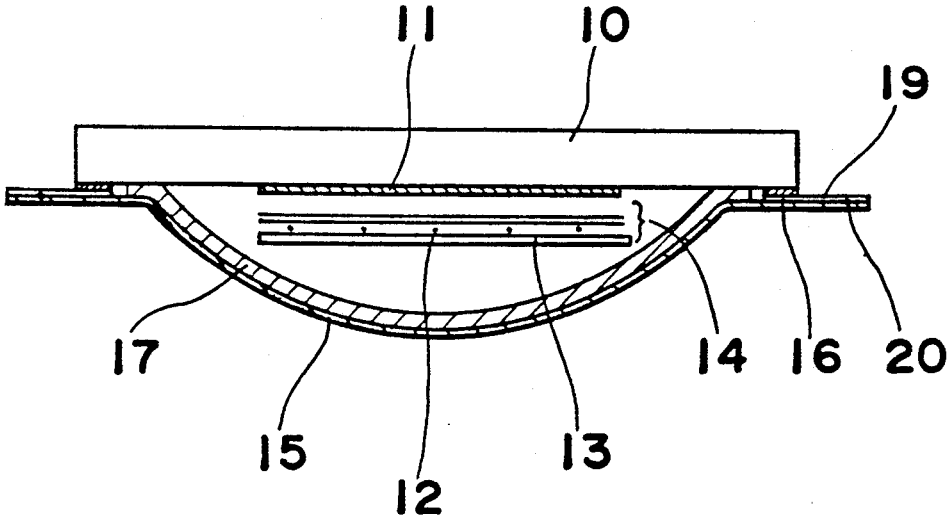
FIG. 6 is a cross sectional view of a third embodiment of the envelope according to the present invention.

FIG. 6 shows a third embodiment of the present invention in which there is used a metal plate 19 made of metal such as, for example 42-6 an alloy which is alloy of 42% Ni, 6% Cr and remainder Fe, having an expansion coefficient near the expansion coefficient of the face glass plate 10. The outmost edge of the metal plate 19 is larger than the outmost edges of the outer container 15 and the face glass plate 10 so that the outer portion of the metal plate 19 is projected outwardly from the flange of the outer container 15 and the metal plate 19 is joined to the flange portion of the face glass plate 10 by fritting 16 and further the metal plate 19 is joined to the flange portion of the outer container 15 at the portion 20 by way of laser welding to provide an envelope 8. In this embodiment, one advantage is that it is unnecessary to increase the temperature for the sealing of the envelope and sealing can be completed in a short time. A further advantage is that since the outer container is not fritting joined, the expansion coefficient of the metal of the outer container can be selected as desired and it is possible to use an inexpensive metal.

As mentioned above, in the respective embodiments, of the flat panel display device according to the present invention, the metal container or the outer container can be affixed to the glass plate in a stable condition without causing any cracking, the display device can be manufactured at a low cost and the characteristic of the display device can be made stable. In addition, the various members of the display members can be sealed stably in a vacuum, so that the characteristics of the display device ca be stabilized.

Figure 7:
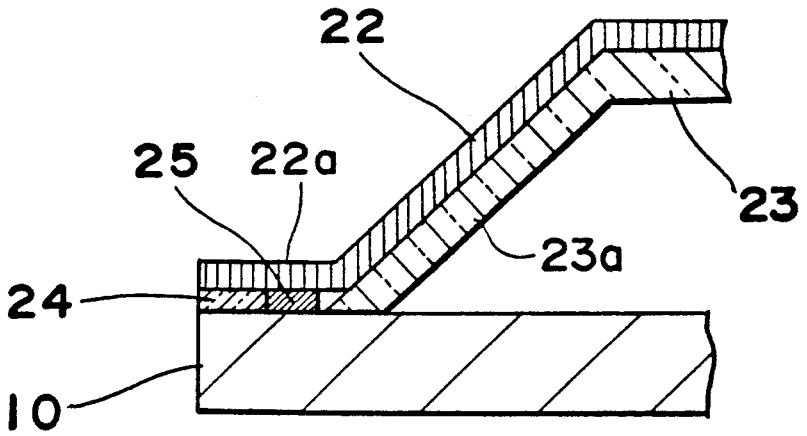
FIG. 7 is a cross sectional view of a 4th embodiment of the envelope according to the present invention.

FIG. 7 shows a 4th embodiment of the flat panel display device according to the present invention in which the outer container 22 made of a thin metal has its flange portion 22*a* affixed to the peripheral portion of the face glass plate 10 through a frit glass 24 The pressure tight container 23 is merely placed on the glass plate 10 without joining to the face glass plate. A blocking member 25 is disposed between the flange portion 22*a* of the outer container 22 and the face glass plate 10 at a position between the frit glass 24 and the lower portion of the peripheral wall 23*a* of the pressure tight container 23 so as to prevent the molten frit glass 24 from reaching the contact portion of the lower end of the wall 23*a* of the pressure tight container 23 and the face glass plate 10 at the time of sealing the outer container 22 and the flat glass plate 10. The blocking member 25 is made of for example the same kind of glass as the face glass plate 10. With the same glass as the glass of the face glass plate 10, when the frit glass 24 situated between the outer container 22 and the face glass plate 10 is molten due to a high temperature of 350° C. to 450° C. in the production process of the vacuum envelope and a part of the molten frit glass 24 reaches the contact surface of the blocking member 25 and the face glass plate 10 and both parts 25 and 10 are joined by the frit glass 24, it is possible to eliminate a problem of the thermal stress caused by joining of the face glass plate 10 and the blocking member 25 since the flat glass plate 10 and the blocking member 25 have the same thermal expansion coefficient.

The blocking member 25 may be affixed to the face glass plate 10 by fritting in advance before joining of the face glass plate 10 and the outer container 22.

Figure 8:
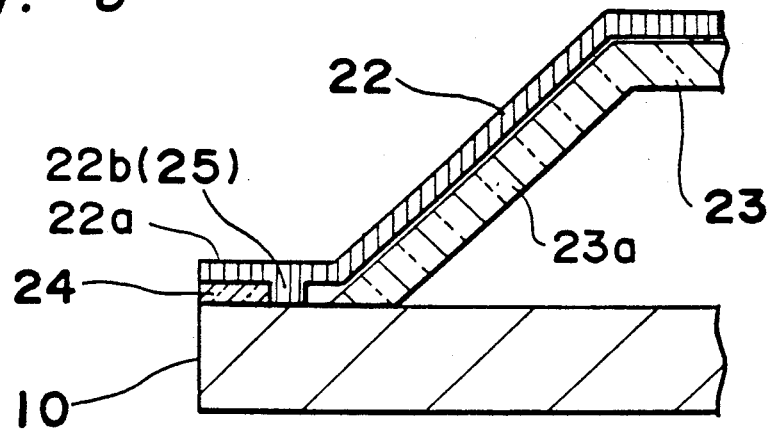
FIG. 8 is a cross sectional view of a 5th embodiment of the envelope according to the present invention.

In a fifth embodiment shown in FIG. 8, a rib 22*b* is formed on the contact surface of the flange 22*a* of the outer container 22 in a position between the frit glass 24 and the peripheral wall 23*a* of the pressure tight container 23 so that the rib 22*b* contacts with the top surface of the face glass plate and acts as the blocking member 25.

Figure 9:
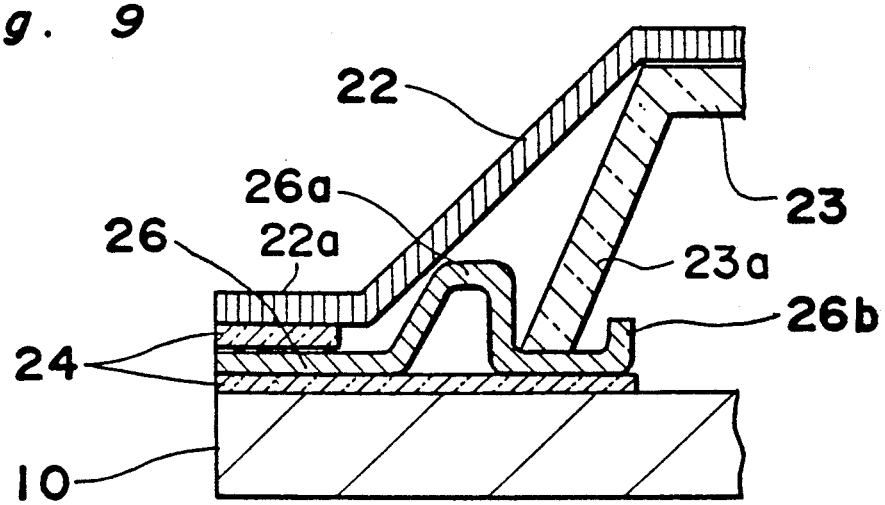
FIG. 9 is a cross sectional view of a 6th embodiment of the envelope according to the present invention.

FIG. 9 shows a 6th embodiment which is suitable in a case in which the difference of the thermal expansion coefficients of the face glass plate 10 and the outer container 22 is large and it is necessary to provide a buffer member 26 for joining the flat glass plate 10 and the outer container 22. In the embodiment shown, there are sandwiched the upper frit glass layer 24, the buffer member 26 and the lower frit glass layer 24 between the face glass plate 10 and the outer container 22. The buffer member 26 is bent to form a projection 26*a* at a position between the flange portion 22*a* of the outer container 22 and the peripheral wall 23*a* of the pressure tight container 23 and further bent to form an inner wall 26*b* projected upward.

In case the buffer member 26 is placed as described above, when the device is heated in the production process of the vacuum envelope, the frit glass flows from both of the upper portion and the lower portion of the buffer member 26. The flow of the frit glass can be stopped by the projection 26*a* and inner wall 26*b* which act as the blocking members. Therefore, in this embodiment, it is not necessary to provide a separate blocking member as shown in the embodiment shown in FIG. 7.

Figure 10:
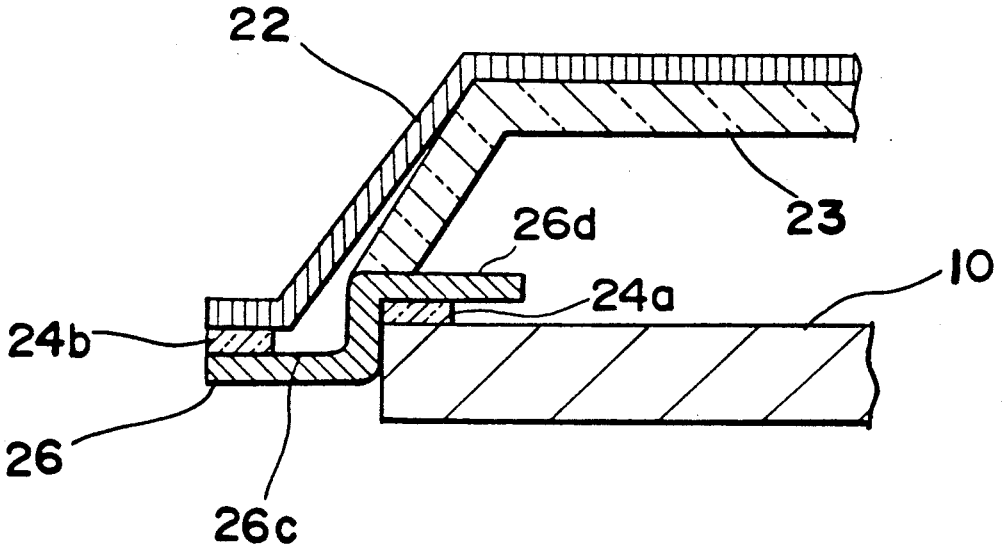
FIG. 10 is a cross sectional view of a 7th embodiment of the envelope according to the present invention.

FIG. 10 shows a 7th embodiment which is used in case the difference of the thermal coefficients of the face glass plate 10 and outer container 22 is large and the buffer member 26 is used. In the arrangement shown in FIG. 10, the buffer member 26 is formed in a step shape with the upper portion 26*d* placed on the face glass plate 10 through the frit glass 24*a* and the lower portion 26*e* projects outwardly from the periphery of the face glass plate 10 so that the joining face 26*c* of the buffer member 26 joined to the flange portion of the outer container 22 is situated on a level lower than the upper surface of the face glass plate 10. Accordingly, even when the frit glass 24*b* situated on the joining face 26*c* on which the buffer member 26 and the outer container 22 are joined and the frit glass 24*a* situated on the joining face on which the buffer member 26 and the flat glass plate 10 are joined flow, both of the flown frit glass never reach the contact point of the pressure tight container 23 and the buffer member 26. Therefore, there does not occur a problem of the thermal stress due to joining of the pressure tight container 23 and the buffer member 26. In this embodiment, it is not necessary to join the outer container 22 and the buffer member 26 by the frit glass4 but there may be used any other way of joint such as the laser welding which can assure the hermetic seal.

Figure 11:
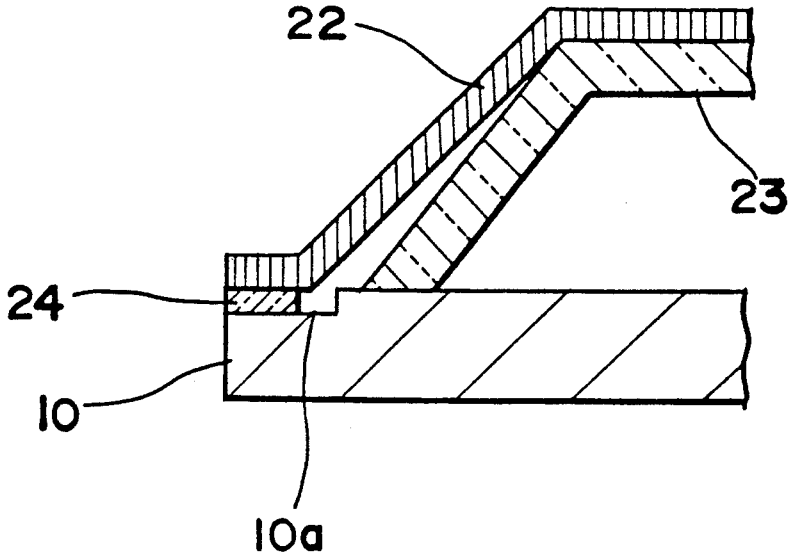
FIG. 11 is a cross sectional view of a 8th embodiment of the envelope according to the present invention.
Figure 12:
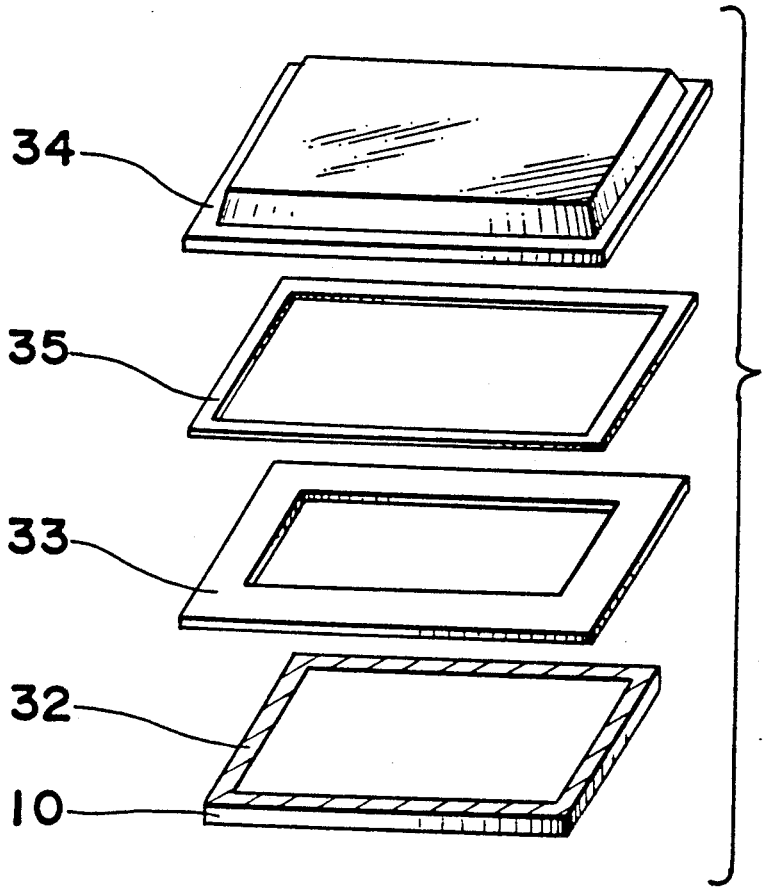
FIG. 12 is an exploded view of a 9th embodiment of the envelope according to the present invention.

FIG. 11 shows an 8th embodiment in which the frit glass 24 is placed at the portion 10*a* of the face glass plate 10 which is downwardly stepped from the top face of the flat glass plate 10 so that flow of the molten frit glass can be prevented.

As described in the embodiments shown in FIGS. 7 to 11, the frit glass does not reach inner part of the flat glass plate, even when the frit glass is molten at the joining portion between the outer container and the flat glass plate in the production process of the vacuum envelope, the flat glass plate and the pressure tight member are not bonded, whereby the thermal stress is kept minimal and assuring to produce the flat panel display device can be produced with high reliability.

FIGS. 12 to 15 show a 9th embodiment of the present invention.

In FIGS. 12 to 15, 10 is the face glass plate which is made of transparent soda float glass and is the same glass plate used in the various embodiments, 32 denotes frit glass or glass particles of low melting temperature for sealing, 33 a weldable member made of 42-6 alloy, (specifically, Ni 42%, Cr 6% and remainder Fe) having a thermal expansion coefficient which is the same as the thermal expansion coefficient of the glass, 34 an outer container or a back plate made of metal and opposing to the face glass plate 10 and 35 a metal member or particles having a melting temperature lower than the melting temperature of the back plate 34 and which is wettable for both the back plate 34 and the weldable member 33.

Figure 13:
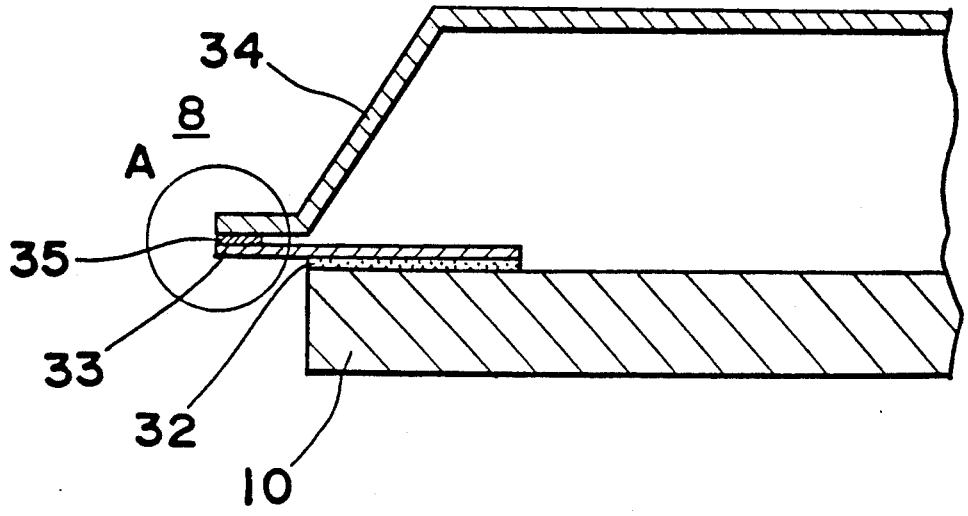
FIG. 13 is a cross sectional view of a 9th embodiment of the envelope according to the present invention.

The envelope 8 of the flat panel display device in the 9th embodiment is produced in such a manner as described hereinafter. As shown in FIG. 13, the frit glass 32 is coated between the face glass plate 10 and the weldable member 33 and the envelope is heated in an electric furnace at about 450° C., whereby the flat glass plate 10 and the weldable member are joined. Thereafter, the back plate 34 is tightly contacted with the weldable member 33, then the peripheral edges of the above arrangement are welded by a high density welding such as $CO_2$ laser welding to seal the envelope tightly. However, since there are deformations such as crinkles in the peripheral portions of the back plate 34 caused by pressing work, it may occur that the amount of the deformation exceeds the allowance of the gap between the works of the laser welding.

Figure 14:
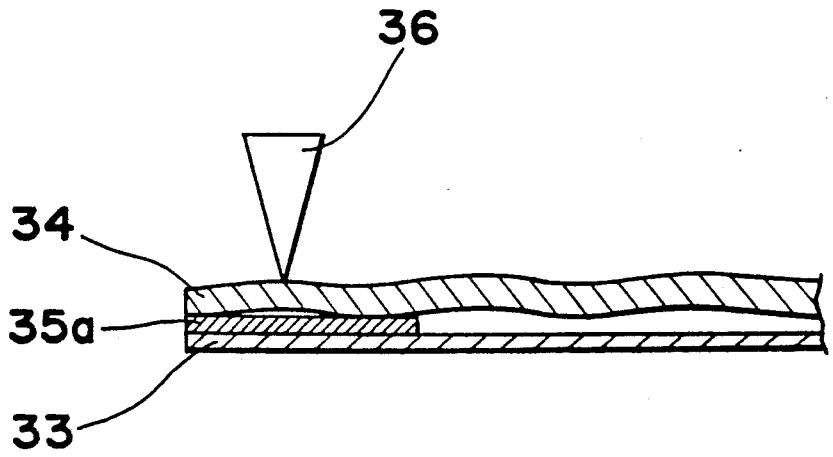
FIG. 14 is a cross sectional view of an essential portion of the 9th embodiment of the envelope according to the present invention.

In this embodiment, as shown in FIG. 14, a metal member 35*a* which is wettable to the back plate 34 and the weldable member 33 and has a melting point lower than that of the back plate 34 is placed between the welding portion of the back plate 34 and the weldable member 33 and they are tightly contacted and the peripheral edges of the envelope 8 are sealed in an air tight seal by $CO_2$ laser welding so that the gap is filled by the welding material.

When the gap is large or the deformation is complicated it may occur that the gap is not filled by the welding material. In this case, in place of the metal member 35*a*, particles 35*b*are used. The particles 35*b* are wettable to the to the back plate 34 and the weldable member 33 and has a melting temperature lower than the melting temperature of the back plate 34.

Figure 15:
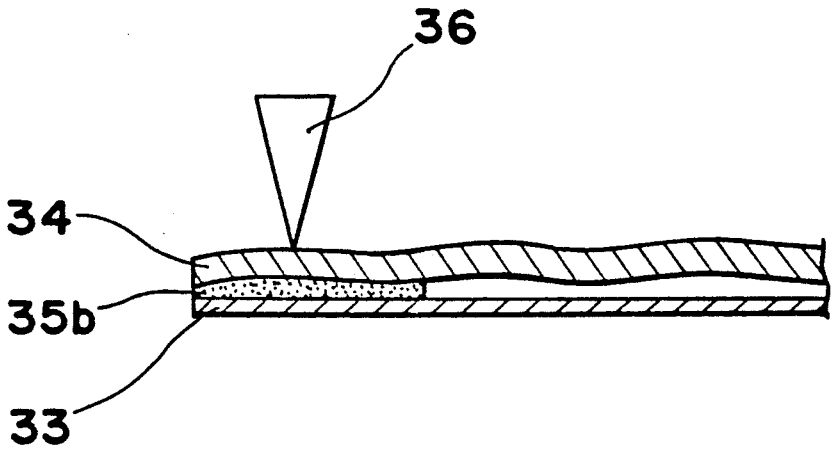
FIG. 15 is a cross sectional view of an essential portion of a modification of the 9th embodiment of the envelope according to the present invention.

One example of the way of filling the particles 35*b* is explained hereinafter with reference to FIG. 15. The particles 35*b* are mixed with the organic binder and the mixture is coated on the welding portion of the flange of the back plate 34 relatively thick. Then the back plate 34 coated by the mixture is heated up to 300° C. to 350° C. so as to release the inorganic material and being simultaneously pressed so as to increase the density of the particle layer 35*b* and causing the weldable member 33 to be tightly contacted to the particle layer 35*b*. By this way, the gap between the welding portion of the back plate 34 and the welding portion of the weldable member 33 are filled by the particles of a high density, whereby the particle layer 35*b* can act as a meting layer and further act as a joining layer.

According to the 9th embodiment, it is possible to make the joining portion of the envelope simple without requiring a highly accurate joining and to provide the envelopes of the display devices with a good air tight sealing and a high reliability.

Figure 16:
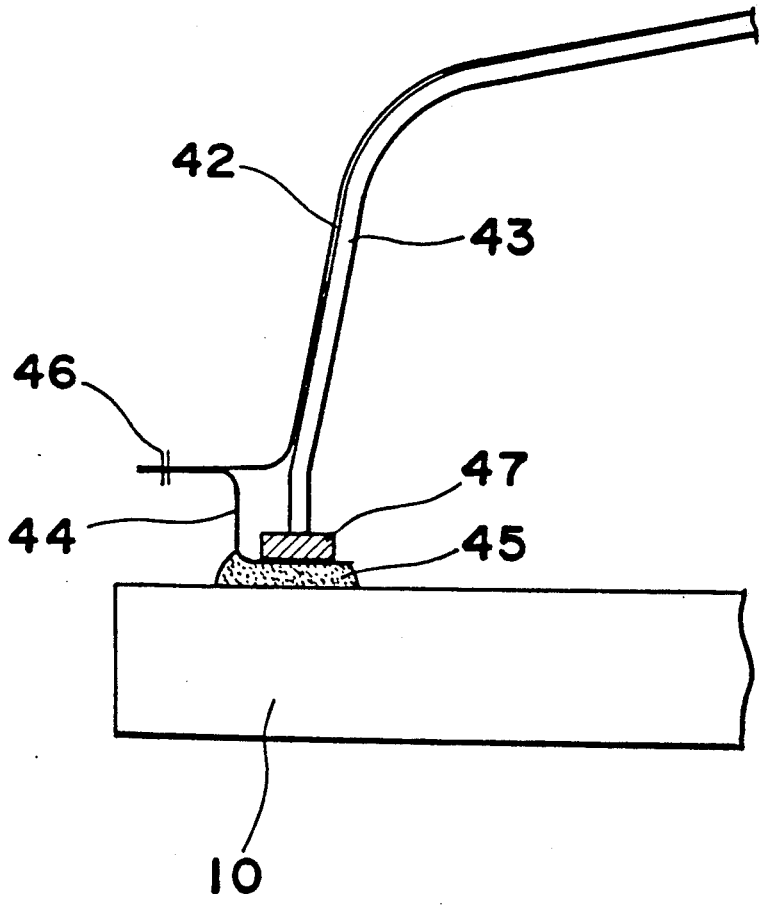
FIG. 16 is a cross sectional view of an essential portion of a 10th embodiment of the envelope according to the present invention.

FIG. 16 shows a 10th embodiment in which 10 denotes the face glass plate, 42 an outer container made of thin metal, 43 a pressure tight container, 44 a joining member having a thermal expansion coefficient substantially the same as that of the face glass plate 10, 45 frit glass of a low melting temperature for sealing, 46 an air tight seal portion made by laser welding and 47 a buffer member which is inserted between the lower end portion of the peripheral wall of the pressure tight container 43 and the flat glass plate 10 or joining member 44.

In the arrangement described above, when the envelope is evacuated and air impinges from outside, the pressure by the pressure tight container 43 is applied to the face glass plate 10 through the buffer member 47, so that the stress in the face glass plate 10 can be relieved. When the pressure is applied to the frit glass 45 through the joining member 44, such pressure is applied to the frit glass through the buffer member 47, whereby the stress occurs in the frit glass 45 and face glass plate 10 can be relieved. As the buffer member 47, it is effective to use a spreading metal or soft metal such as aluminum.

As the buffer member 47, there may be used rubber or plastic resin.

In a high temperature processing of 350° C. to 450° C., in the production of the envelope, there occurs a thermal stress due to the difference of the thermal expansion coefficient between the joining member 44 and the flat glass plate 10. The effect of the difference of the thermal coefficient is particularly great when the enclosure is bulky. In order to decrease the thermal stress, it is necessary to make the outer container 42 and the joining member 44 of a thin material. However, when the flat glass plate 10 and thin joining member 44 are joined by the frit glass 45, the joining strength becomes small.

Figure 17:
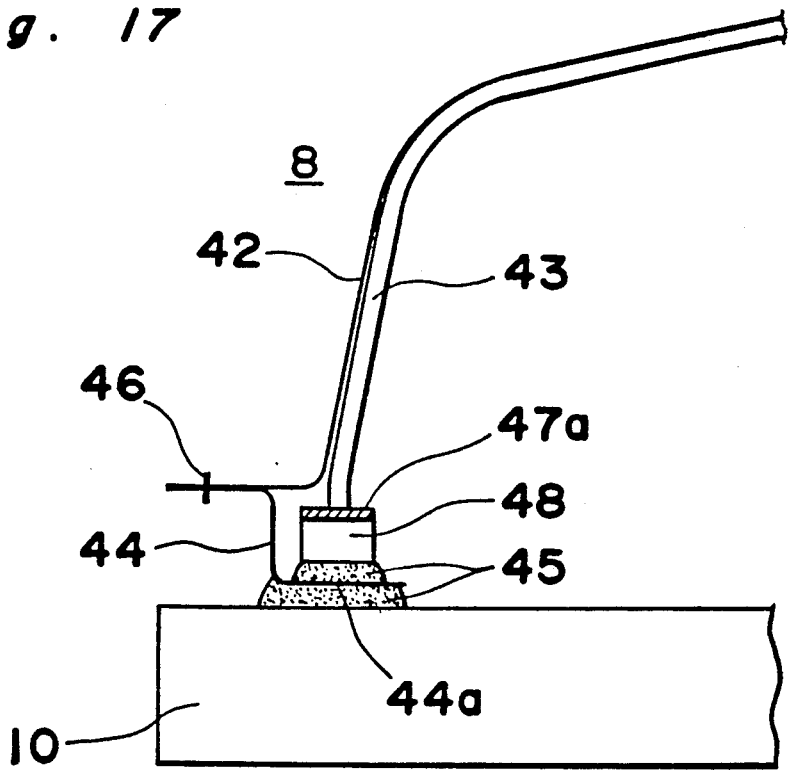
FIG. 17 is a cross sectional view of an essential portion of a 11th embodiment of the envelope according to the present invention.
Figure 18:
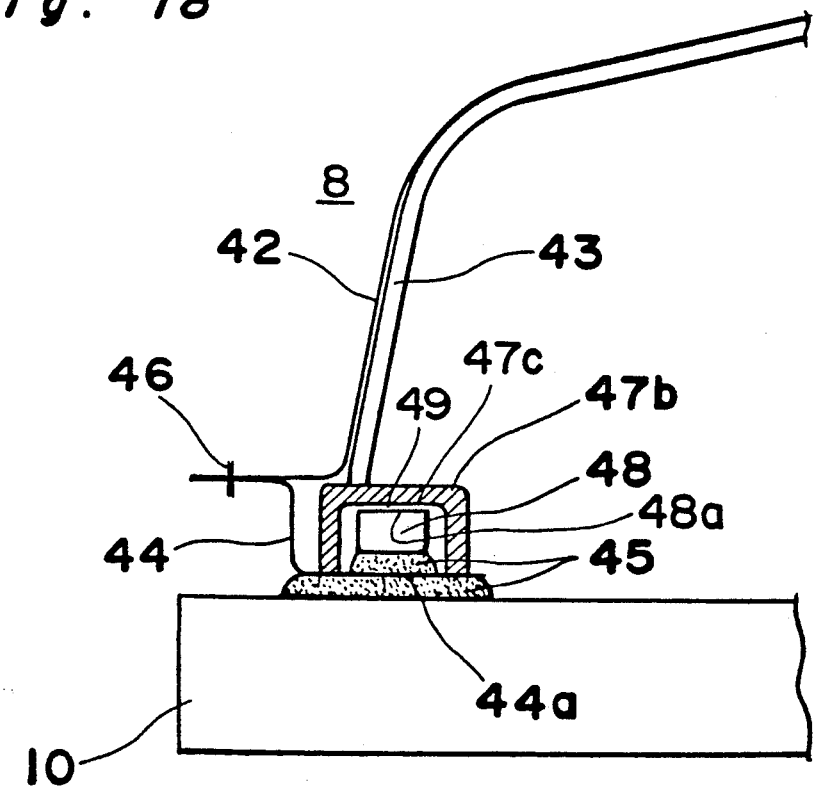
FIG. 18 is a cross sectional view of an essential portion of a 12th embodiment of the envelope according to the present invention.

FIGS. 17 and 18 show 11th and 12th embodiment for increasing the joining strength.

Referring to FIG. 17, 48 denotes a reinforcing member made of preferably a glass member which is the same as the glass of the flat glass plate. As the reinforcing member 48, there may be used a metal member such as 42-6 alloy having the same or close thermal expansion coefficient to that of the face glass plate 10. The joining member 44 is provided with a through hole 44*a* and the reinforcing member 48 is joined to the flat glass plate 10 by the frit glass 45 through the joining member 44. In case the reinforcing member 48 is made of 42-6 alloy, it is desired that the reinforcing member be as thin as possible for decreasing the thermal stress which occurs when they are joined by the frit glass.

A buffer member 47*a* is disposed between the pressure tight container 43 and the reinforcing member 48 so as to decrease the pressure applied to the reinforcing member 48 from the pressure tight container 43 by the buffer member 47*a*, whereby it is possible to decrease the stress concentration on the reinforcing member 48, the frit glass 45 and the face glass plate 10.

FIG. 18 shows a 12th embodiment in which the buffer member 47*b* is shaped in a form of an inverted U in cross sectional view and is situated on the joining member 44 so as to surround the reinforcing member 48. The pressure tight container 43 is placed on the buffer member 47*b*. There is provided a predetermined gap 49 between the inner top surface 47*c* of the buffer member 47*b* and the top surface 48*a* of the reinforcing member 48. By providing the gap 49 between the buffer member 47*b* and the reinforcing member 48, when the envelope 8 is evacuated and put in air, the pressure of the air does not act on the reinforcing member 48 but acts only on the buffer member 47*b* made of soft metal such as aluminum, which can be deformed, thereby decreasing the stress acting on the frit glass 45 and the face glass plate 10. Accordingly, even if the reinforcing member 48 is made of glass which is brittle, the reinforcing member is prevented from breaking, therefore, the safety of the envelope can be increased. Since the envelope is safe as mentioned above, it is possible to make the outer container and pressure tight container by a material of relatively large thermal expansion coefficient, whereby the manufacturing cost of the flat panel display devices can be decreased.

It is an advantage that the stress acting on the pressure tight container and the flat glass plate due to the air pressure acting on the envelope which is evacuated can be decreased so that the safety of the envelope in terms of the vacuum pressure strength can be increased.

Another advantage of the embodiments is to increase the joining strength even if the joining member is made of a thin member and the stress concentration can be decreased without reducing the effective picture size ratio.

What is claimed is:

1. A vacuum envelope, comprising:

a glass plate having a peripheral edge portion;

an outer container for mounting on said glass plate and having a peripheral edge portion;

a pressure tight container within said outer container and having a peripheral edge;

a joining means between the peripheral edge portion of said glass plate and the peripheral edge portion of said outer container for joining said peripheral edges to each other, said joining means having a joining member connected to the peripheral edge of said outer container and a frit on the peripheral edge of said glass plate to which said joining member is connected; and a buffer means of a deformable spreadable material engaged between the peripheral edge of said pressure tight container and one of said joining means and said glass plate.

2. A vacuum envelope as claimed in claim 1 in which said glass frit is on said glass plate and said joining member is on said glass frit, and said buffer means is on said joining member where it contacts said glass frit.

3. A vacuum envelope as claimed in claim 1 in which said glass frit is on said glass plate and said joining member is within said glass frit, and said joining means further includes a reinforcing member extending circumferentially of said glass plate and engaged on said glass frit, and said buffer means is on said reinforcing member over said joining member.

4. A vacuum envelope as claimed in claim 1 in which said glass frit is on said glass plate and said joining member is within said glass frit, and said joining means further includes a reinforcing member extending circumferentially of said glass plate and engaged on said glass frit, and said buffer means is an inverted U-shaped cross-section member engaged on said reinforcing member and bridging said reinforcing member.

5. A vacuum envelope as claimed in claim 1 in which said buffer means is spreadable metal member.

* * * * *